United States Patent [19]

Urban et al.

[11] Patent Number: 5,056,459

[45] Date of Patent: Oct. 15, 1991

[54] CABINET FOR ELECTROSTATIC PAINTING

[75] Inventors: Lino Urban, Gerenzano; Gian F. Moscardini, Cornaredo; Gabriele Missier, Milan, all of Italy

[73] Assignee: Trasmetal di Gabriele Missier, Milan, Italy

[21] Appl. No.: 509,836

[22] Filed: Apr. 17, 1990

[30] Foreign Application Priority Data

Apr. 21, 1989 [IT] Italy ..... 20244 A/89

[51] Int. Cl.[5] ..... B05B 15/12

[52] U.S. Cl. ..... 118/634; 118/309; 118/323; 118/326; 55/DIG. 46; 15/345

[58] Field of Search ..... 118/309, 326, 323, 634, 118/631; 55/DIG. 46; 98/115.2; 239/103, DIG. 22; 15/345

[56] References Cited

U.S. PATENT DOCUMENTS 3,905,785 9/1975 Fabre ..... 118/634
3,942,420 3/1976 Marino ..... 118/DIG. 7
4,036,438 7/1977 Soderlind et al. ..... 239/DIG. 22
4,700,890 10/1987 Hasegawa ..... 239/103

FOREIGN PATENT DOCUMENTS 2141642 1/1985 United Kingdom .

*Primary Examiner*—Richard V. Fisher
*Assistant Examiner*—Charles K. Friedman
*Attorney, Agent, or Firm*—Diller, Ramik & Wight

[57] ABSTRACT

A cabinet (1) for electrostatic painting which includes a framework (2) supporting flat walls (3) whose surfaces (5) bound a volume inside of which at least pneumatic distributor (6) is installed to distribute powder onto a workpiece (7) which is to be painted thereby. The powder which is not applied to the workpiece settles on the interior surfaces of the walls and is removed therefrom by a combination of air blown from a blowing mouth (20) against the inner surface (5) of each wall in opposition to an air stream generated by a suction mouth (19). During the opposition of the suction and blowing mouths (19, 20, respectively), each wall is moved past the mouths whereby each wall is thereby progressively cleaned of the powder.

11 Claims, 3 Drawing Sheets

CABINET FOR ELECTROSTATIC PAINTING

BACKGROUND OF THE INVENTION

The present invention relates to a cabinet for electrostatic painting, which comprises a framework which supports flat walls, whose inner surfaces bound a volume inside which at least one pneumatic distributor is installed, which distributes the powders to be applied onto the workpiece to be painted, also contained inside said volume.

In the field of the electrostatic painting, the painting cabinets essentially perform two functions. The first function is of preventing the organic powders, which are delivered by the pneumatic distributor(s) and do not fulfil their task of forming the desired coating on the workpiece, from propagating throughout the surrounding environment.

The second function is of making it possible said powders to be at least partially recovered, with undoubted economical advantages and of environmental protection. In this regard, the rate of proper application of the powders delivered by the pneumatic distributor onto the surfaces of the workpiece is estimated to be of 30% on the average. In the field of electrostatic painting by means of powders, contrarily to what happens in case of painting by means of solvent-based paints, each time that the colour of the coating powder is changed, any traces of the preceding powder, and namely, not only those powder residues which are contained inside the pneumatic distributor and in the relevant equipment, but also those which settle on all of the interior surfaces of the walls of the cabinet, have to be removed.

In fact, the risk exists that the previously used powder, only provisorily sticking to the inner surfaces of the walls of the cabinet, gets detached from said surfaces going to form the coating on the workpiece together with the powder which is being presently delivered by the distributor, thus altering the end colour of said workpiece.

In the cabinets known from the prior art, the cleaning of the inner surfaces is carried out by means of a manual procedure at each colour change.

Both the uncomfort and the costs deriving from such an operation need not be explained.

A more technologically advanced type of cabinets have such a structure as to make it possible for the walls of the same cabinet to be easily replaced. Such walls are made from sheets of plastic materials, to be disposed of after use.

Also such a kind of solution is not free from drawbacks, such as, e.g., the need of having to materially purchase and install the plastic sheets to be used, and of disposing of the used sheets. The handling of the used sheets requires special precautions, dictated by the toxicity of the substances which coat them.

SUMMARY OF THE INVENTION

The purpose of the present invention is of providing an electrostatic-painting cabinet which is capable of obviating the above said drawbacks.

Such a purpose is achieved by a cabinet for electrostatic painting comprising a framework supporting flat walls whose inner surfaces bound a volume inside which at least one pneumatic distributor is installed, which distributes the powders onto a workpiece to be painted, also contained inside said volume, which cabinet is characterized in that it comprises means for removing the powder which settles on all of the inner surfaces of said walls, with said means comprising at least one sucking mouth per each wall, which sucking mouth generates an air stream which scans the inner surface of the wall.

The present invention is illustrated for mererly exemplifying, non-Limitative purposes, in the figures of the hereto attached drawing tables, wherein:

DESCRIPTION OF THE PREFERRED EMBODIMENTS

Figure 1:
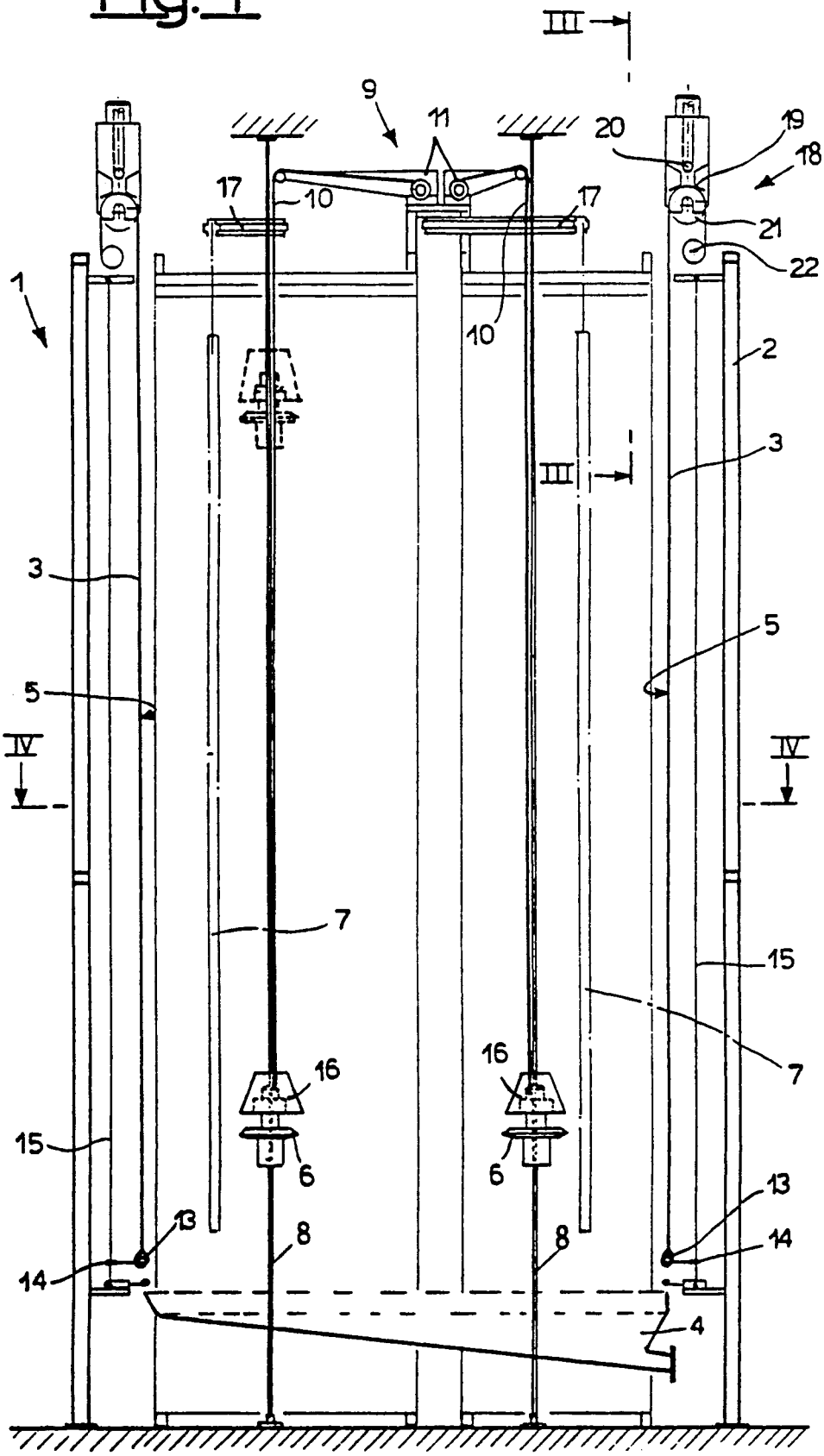
FIG. 1 shows a schematic, sectional view of a cabinet according to the present invention.

Referring to the above mentioned figures, and, in particular, to FIG. 1, the cabinet for electrostatic painting 1 according to the present invention comprises a metal framework 2, a plurality of flat walls 3 and a bottom 4.

The metal framework 2 supports the flat walls 3 made from a material, in flexible sheet form, such as, e.g., TEFLON (polytetrafluoroethylene) sheets, which are endowed with the characteristic that they prevent the organic powders used for the electrostatic painting from sticking to their surfaces.

The inner surfaces 5 of the walls define a volume (the useful volume of the cabinet), inside which there is at least one pneumatic powder distributor 6 acting on a workpiece 7 to be painted. In the herein exemplified case, the pneumatic powder distributor 6 is of circular type, sliding along a vertical guide 8 running through its centre, by means of a drive mechanism 9 comprising a belt 10 acting as a rope, associated with a winch 11.

In the herein depicted case, the workpiece 7 to be painted has a rectilinear structure and is arranged parallel to the guide 8.

Each pneumatic distributor 6 is associated with means suitable for preventing it from accidentally bumping against the workpiece to be painted. Such means substantially comprise at least one element 16 of conefrustum shape whose larger end is close to the pneumatic distributor 6 and has a longer external diameter than the pneumatic distributor 6.

In such a way, possible oscillations of the workpiece 7 around the support guide 17 it is constrained to, do not hamper the movement of the distributor 6 along the vertical guide 8 and to not cause impacts to occur between the workpiece and the pneumatic distributor 6, thus safeguarding it.

Figure 2:
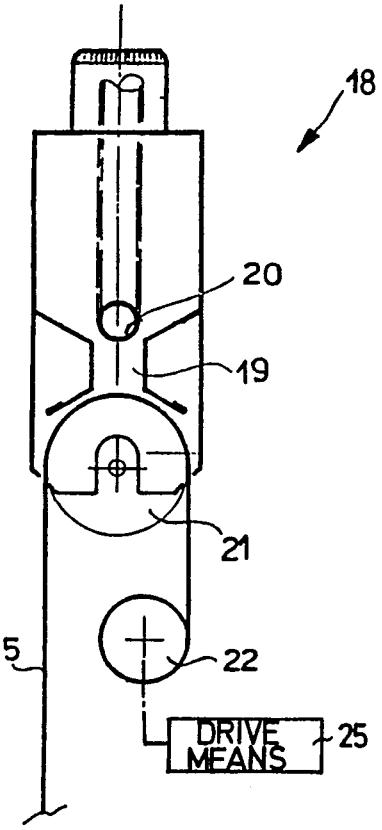
FIG. 2 shows a schematic, sectional view of the means for the removal of the powder which settles on the inner surfaces of the walls of the cabinet.
Figure 3:
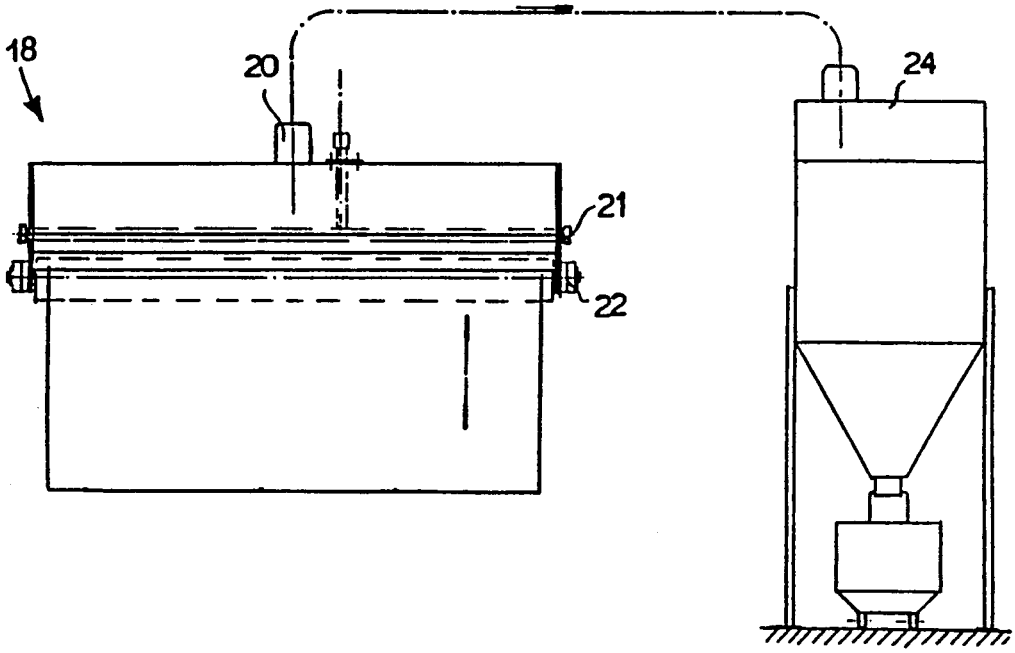
FIG. 3 shows a schematic, sectional view according to path III—III of FIG. 1, integrated with filtration means not shown in FIG. 1.

Each wall 3 is associated with means for removing the powder which settles on its inner surface 5 (reference is made in particular to FIGS. 2 and 3). Said means, generally indicated with the reference numeral 18, are housed, e.g., at the top end of each wall 3 and comprise at least one sucking mouth 19, at least one blowing mouth 20, coaxial with each other, and a winding device comprising a return or idle roller 21 and a winding roll 22 driven by conventional drive means 25.

The blowing mouth 20 generates an air jet directed towards the inner surface 5 of the wall 3, and in contercurrent to the air flow generated by the sucking mouth 19.

The cleaning of the inner surface of each wall 3 of the cabinet 1 is obtained by means of the relative movement of the wall 3 relatively to the blowing mouth 20 and to the sucking mouth 19. In the herein exemplified case, the sliding occurs of the material in flexible sheet form the wall 3 is made from, around the return roller 21 installed on the vertical of the sucking mouth 19 and blowing mouth 20, in such a way that the inner surface 5 is facing said mouths (19, 20), which obviously extend throughout the length of the wall on which they operate.

In practice, the detachment and removal of the powder from the inner surface 5 of the wall 3 takes place in two steps: at least one first step of detachment of the powder by means of a pressurized air jet directed towards said inner surfaces 5, and at least one second step of removal of the powder detached by the air jet, by means of a sucking air stream, substantially in countercurrent to said air jet.

The air jet, which carries out the detaching action, is at a high pressure, its flowrate is low and its action is localized along a face having a length equal to the length of the wall it acts on.

On the contrary, the air stream, which carries out an action of removal of the already detached powders is, relatively to said air jet, at a low pressure, its flowrate is high and its action is localized sideways to the face on which the jet acts.

According to an alternative form or practical embodiment, one might furthermore think of only using the sucking air jet for both of said detachment/removal steps.

In any case, the intaken air, which obviously is saturated with powders, is sent to filtration means comprising, e.g., an end filter 24 which makes it possible the powders to be separated from the air stream—and possibly recovered.

During the use of the cabinet 1 and during the reciprocating movements of winding and unwinding of each wall 3 on/from the roll 22, each wall 3 is kept flat and taut by means of a counterweight 13 applied to its bottom end.

The counterweight 13 is furthermore provided with wall guide means comprising a ring 14 running along a taut, rectilinear cable 15 arranged in vertical position.

Figure 4:
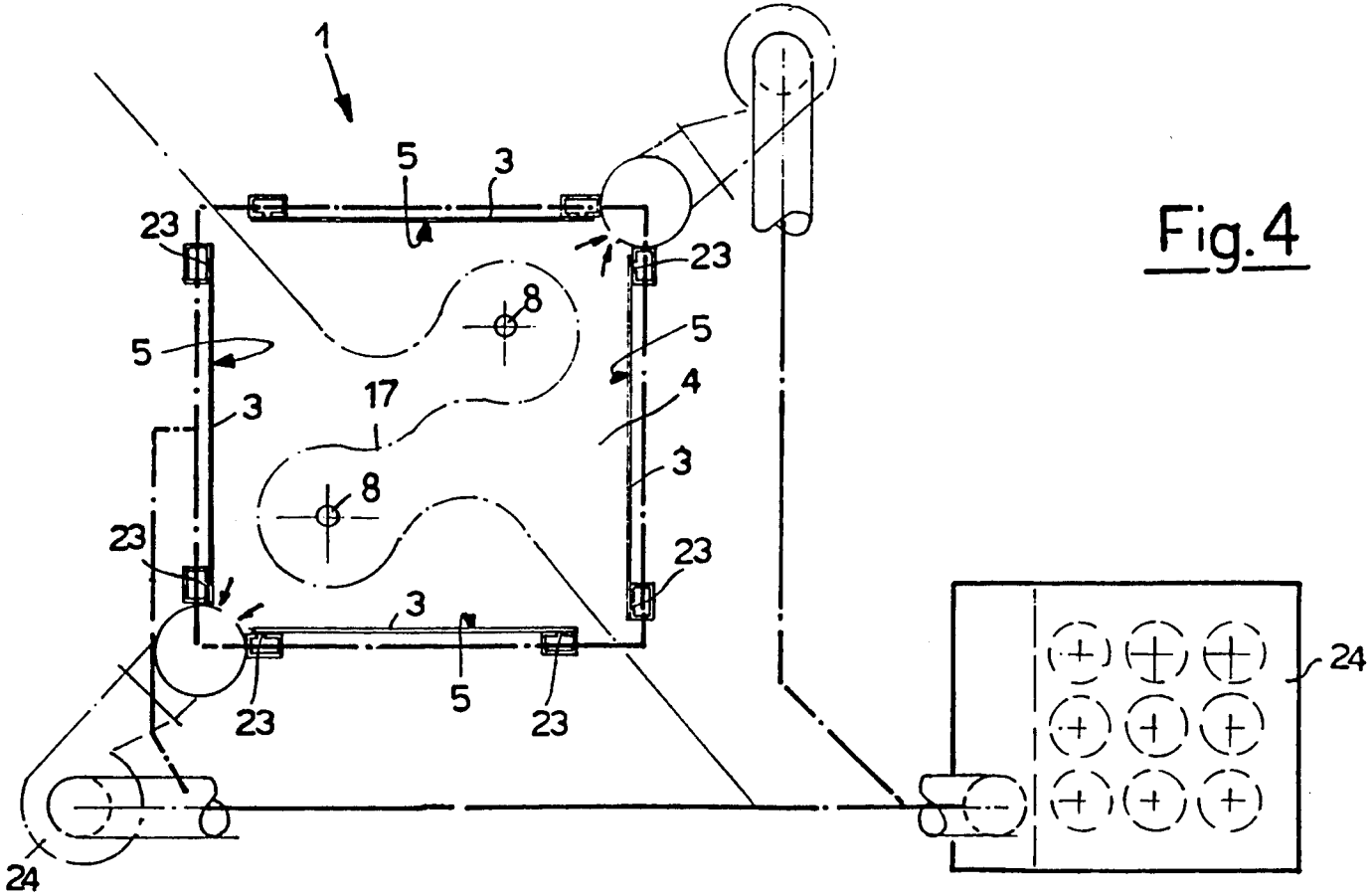
FIG. 4 shows a schematic, sectional view according to path IV—IV of FIG. 1, integrated with filtration means not illustrated in FIG. 2.

Referring in particular to FIG. 4, the vertical edges of each wall 3 are constrained to the framework of the cabinet by means of a plurality of intaking or suction nozzles 23 vertically lined-up along each edge.

Also the air intaken by the nozzles 23 is submitted to filtration by means of the same end filter 24.

We claim:

1. Cabinet (1) for electrostatic painting comprising a framework (2) supporting flat walls (3) whose inner surfaces (5) bound a volume inside which at least one pneumatic distributor (6) is installed, which distributes the powders to be applied onto a workpiece (7) to be painted, also contained inside said volume, which cabinet is characterized in that it comprises means (19) for removing the powder which settles on all of the inner surfaces of said walls, said means (19) comprising at least one suction mouth (19) per each wall (3), which suction mouth (19) generates an air stream adjacent to and which cleans the inner surface (5) of the wall (3), and means (22) for moving each wall (3) past its associated suction mouth (19) to thereby progressively clean each wall (3) during the movement thereof.

2. Cabinet according to claim 1, characterized in that each suction mouth (19) operates in association with at least one blowing mouth (20), with said blowing mouth (20) generating an air jet directed towards the inner surface (5) of the wall (3) and in counter-current to the air stream generated by the suction mouth (19).

3. Cabinet according to claim 2, characterized in that the suction mouth (19) and the blowing mouth (20) are coaxial with each other.

4. Cabinet according to claim 3, characterized in that the progressive cleaning of the inner surface (5) of each wall (3) of the cabinet (1) is obtained by means of the movement of the wall (3) with respect to the blowing mouth (20) and to the sucking mouth (19).

5. Cabinet according to claim 4, characterized in that each wall (3) of the cabinet (1) is made from a material in flexible sheet form taut by gravity and associated at one of its ends with said wall moving means (22) comprising an idle roller (21) positioned on the vertical of the suction mouth (19) and of the blowing mouth (20), around which idle roller (21) the flexible sheet material forming the wall (3) returns, so that during the winding of the wall (3) the inner surface (5) of said wall (3) faces said mouths (19, 20).

6. Cabinet according to claim 5, characterized in that the flexible sheet material which constitutes the walls (3) is selected from among those materials for which the powders show a poor adhesion strength.

7. Cabinet according to claim 6, characterized in that the material from which the walls (3) are made is polytetrafluoroethylene.

8. Cabinet according to claim 5, characterized in that each wall (3) of the cabinet (1) has vertical edges, with said vertical edges being constrained to the framework (2) of the cabinet (1) by means of a plurality of suction nozzles (23) vertically lined-up along said edges.

9. Cabinet according to claim 8, characterized in that the air stream generated by the suction nozzles (23) is filtered before being discharged to the atmosphere.

10. Cabinet according to claim 1, characterized in that the pneumatic distributor (6) is associated with means capable of preventing said pneumatic distributor (6) from accidentally bumping against the workpiece to be painted (7), said preventing means substantially comprising at least one element (16) of cone frustum shape, whose larger base is close to the pneumatic distributor (6) and has an external diameter longer than the diameter of said pneumatic distributor (6).

11. Cabinet according to claim 1, characterized in that each wall (3) of the cabinet (1) has vertical edges, with said vertical edges being constrained to the framework (2) of the cabinet (1) by means of a plurality of suction nozzles (23) disposed vertically along said cabinet vertical edges.

* * * * *